US011034900B2

(12) United States Patent
Lynch et al.

(10) Patent No.: US 11,034,900 B2
(45) Date of Patent: Jun. 15, 2021

(54) SYSTEM, METHOD, AND APPARATUS FOR GASIFICATION OF A SOLID OR LIQUID

(71) Applicant: MagneGas IP, LLC, Peoria, AZ (US)

(72) Inventors: Christopher Lynch, Largo, FL (US); Christopher Carey, Holiday, FL (US); Kevin Andrew Smith, Nokomis, FL (US); Richard Conz, Seminole, FL (US)

(73) Assignee: MAGNEGAS IP, LLC, Clearwater, FL (US)

( * ) Notice: Subject to any disclaimer, the term of this patent is extended or adjusted under 35 U.S.C. 154(b) by 0 days.

(21) Appl. No.: 16/052,759

(22) Filed: Aug. 2, 2018

(65) Prior Publication Data

US 2019/0048272 A1 Feb. 14, 2019

Related U.S. Application Data

(60) Provisional application No. 62/542,689, filed on Aug. 8, 2017.

(51) Int. Cl.
*C10J 3/82* (2006.01)
*C10J 3/18* (2006.01)

(52) U.S. Cl.
CPC . *C10J 3/82* (2013.01); *C10J 3/18* (2013.01); *C10J 2300/093* (2013.01); *C10J 2300/0959* (2013.01); *C10J 2300/0973* (2013.01); *C10J 2300/1238* (2013.01)

(58) Field of Classification Search
CPC ..... C10J 3/82
See application file for complete search history.

(56) References Cited

U.S. PATENT DOCUMENTS

| | | | |
|---|---|---|---|
| 603,058 | A | 4/1898 | Eldridge |
| 3,003,939 | A | 10/1961 | Rouy |
| 3,992,277 | A | 11/1976 | Trieschmann et al. |
| 4,054,513 | A | 10/1977 | Windle |
| 4,089,770 | A | 5/1978 | Lemke |
| 4,229,307 | A | 10/1980 | Lowe et al. |
| 4,369,102 | A | 1/1983 | Galluzzo et al. |
| 4,566,961 | A | 1/1986 | Diaz et al. |
| 4,567,343 | A | 1/1986 | Sullivan et al. |
| 4,683,146 | A | 7/1987 | Hirai et al. |
| 4,995,805 | A | 2/1991 | Hilliard |
| 5,026,484 | A | 6/1991 | Juvan |
| 5,069,765 | A | 12/1991 | Lewis |
| 5,159,900 | A | 11/1992 | Dammann et al. |
| 5,227,038 | A | 7/1993 | Smalley et al. |

(Continued)

FOREIGN PATENT DOCUMENTS

| | | | |
|---|---|---|---|
| CN | 101584375 | A | 11/2009 |
| CN | 101912033 | A | 12/2010 |

(Continued)

*Primary Examiner* — Douglas B Call
(74) *Attorney, Agent, or Firm* — Perkins Coie LLP

(57) ABSTRACT

A system for gasification of a material includes a plasma generator interfaced to a reaction chamber. A feedstock such as pulverized coal is fed into a plasma jet created by the plasma generator and is gasified by the high temperatures of the plasma jet. The gas produced is then collected, filtered, and utilized, for example, in generating of electricity. Likewise, extra heat produced by the system is also used to generate electricity or other heating purposes

14 Claims, 3 Drawing Sheets

(56) References Cited

U.S. PATENT DOCUMENTS

| | | | |
|---|---|---|---|
| 5,319,176 | A | 6/1994 | Alvi et al. |
| 5,343,699 | A | 9/1994 | McAlister |
| 5,350,692 | A | 9/1994 | Taguchi |
| 5,399,829 | A | 3/1995 | Ogilvie |
| 5,417,817 | A | 5/1995 | Dammann et al. |
| 5,435,274 | A | 7/1995 | Richardson, Jr. |
| 5,482,601 | A | 1/1996 | Oshima et al. |
| 5,514,848 | A | 5/1996 | Ross et al. |
| 5,692,459 | A | 7/1997 | Richardson, Jr. |
| 5,792,325 | A | 8/1998 | Richardson, Jr. |
| 5,792,532 | A | 8/1998 | Richardson, Jr. |
| 5,826,548 | A | 10/1998 | Richardson, Jr. |
| 6,113,748 | A | 9/2000 | Richardson, Jr. |
| 6,117,401 | A | 9/2000 | Juvan |
| 6,153,058 | A | 11/2000 | Richardson, Jr. |
| 6,183,604 | B1 | 2/2001 | Santilli |
| 6,263,838 | B1 | 7/2001 | Richardson, Jr. |
| 6,299,656 | B1 | 10/2001 | Richardson, Jr. |
| 6,299,738 | B1 | 10/2001 | Richardson, Jr. |
| 6,314,918 | B1 | 11/2001 | McFarland et al. |
| 6,421,500 | B2 | 7/2002 | Wittle et al. |
| 6,540,966 | B1 | 4/2003 | Santilli |
| 6,663,752 | B2 | 12/2003 | Santilli |
| 6,673,322 | B2 | 1/2004 | Santilli |
| 6,926,872 | B2 | 8/2005 | Santilli |
| 6,972,118 | B2 | 12/2005 | Santilli |
| 7,105,079 | B2 | 9/2006 | Waldeck et al. |
| 7,780,924 | B2 | 8/2010 | Santilli |
| 8,236,150 | B2 | 8/2012 | Santilli |
| 9,433,916 | B2 | 9/2016 | Marton |
| 9,700,870 | B2 | 7/2017 | Santilli |
| 9,764,335 | B2 | 9/2017 | Santilli |
| 10,100,262 | B2 | 10/2018 | Santilli |
| 10,100,416 | B2 | 10/2018 | Marton |
| 10,189,002 | B2 | 1/2019 | Lynch et al. |
| 10,537,902 | B2 | 1/2020 | Santilli |
| 2001/0038087 | A1 | 11/2001 | Santilli |
| 2003/0051992 | A1 | 3/2003 | Rappa et al. |
| 2003/0133855 | A1 | 7/2003 | Santilli |
| 2003/0230554 | A1 | 12/2003 | Schroder et al. |
| 2006/0148357 | A1 | 7/2006 | Baratian et al. |
| 2009/0235637 | A1 | 9/2009 | Foret |
| 2010/0012163 | A1 | 1/2010 | Alpert et al. |
| 2011/0147231 | A1 | 6/2011 | Gordon et al. |
| 2012/0000787 | A1 | 1/2012 | Santilli |
| 2012/0061618 | A1* | 3/2012 | Santoianni ..... C04B 28/04 252/373 |
| 2012/0100253 | A1 | 4/2012 | Okada et al. |
| 2013/0273480 | A1* | 10/2013 | Santoianni ..... F23L 15/00 431/11 |
| 2014/0157777 | A1 | 6/2014 | Kramer |
| 2014/0332724 | A1* | 11/2014 | Tsangaris ..... C10J 3/726 252/373 |
| 2015/0377079 | A1* | 12/2015 | Noureldin ..... C10J 3/82 60/671 |
| 2018/0093248 | A1 | 4/2018 | Lynch et al. |
| 2020/0239333 | A1 | 7/2020 | Santilli et al. |

FOREIGN PATENT DOCUMENTS

| | | | |
|---|---|---|---|
| JP | 58009661 | A | 1/1983 |
| JP | 2010208893 | A | 9/2010 |

* cited by examiner

SYSTEM, METHOD, AND APPARATUS FOR GASIFICATION OF A SOLID OR LIQUID

CROSS-REFERENCE TO RELATED APPLICATION

This application claims the benefit of U.S. provisional application No. 62/542,689 filed on Aug. 8, 2018, the disclosure of which is incorporated by reference.

FIELD

This invention relates to the field of energy transformation and more particularly to a system for extracting a usable fuel from another material such as coal.

BACKGROUND

The use of certain materials to provide energy for useful work is often precluded by the format of the materials and/or the byproducts of using such materials. For example, in the early 1900s, coal was used as a source of heat in individual homes. The format of coal provides several challenges as it is a solid and has considerable mass. This precludes distributing coal to homes in an automated way as, for example, natural gas is distributed today. In those days, coal was delivered in dump truck and loaded into basement bins through a chute, where the homeowner had to then shovel the coal from the bin into the furnace for heating and hot water production. Even if the economics of such distribution made the use of coal desirable, there still exist several issues that are difficult to overcome in individual households such as the dust created from the delivery and movement of coal and pollution caused in the process of burning the coal in the individual furnaces. The same or similar issues are presented by burning wood, oil, or other liquid fuels in individual homes.

Consider the issues with portable fuel supplies, as used by automobiles, trucks, airplanes, trains, ships, etc. Again, in the early 1900s, coal and wood were used directly as an energy source to move trains and ships, but such is not practical for smaller vehicles such as automobiles and, definitely not usable in aviation. Further, even in larger-scale vehicles (e.g. ships and trains), the distribution/delivery issues along with pollution issues lessens the usefulness of a solid fuel such as coal.

Today, most portable applications such as vehicles derive energy either from electricity or a liquid fuel such as gasoline, diesel, or natural gas. Likewise, most distributed uses of energy (e.g. homes and businesses) are delivered as electricity or in liquid form (e.g. oil/diesel, natural gas, propane). It has been found that delivery and distribution of a liquid fuel is more efficient than of a solid fuel, as in liquid form, the fuel can be easily moved through pipes and hoses and fed directly to homes or delivered in trucks to distribution centers (e.g. gas stations, propane tanks) for refiling of individual tanks (e.g. vehicle tanks, home storage tanks).

Unfortunately, this precludes the use of many readily available and lower-cost energy sources such as coal, wood, landfill material, etc.

What is needed is a system that will convert such energy sources into a usable gas such as syngas.

SUMMARY

In one embodiment, a system for gasification of a material is disclosed including a plasma generator interfaced to a reaction chamber. A feedstock is fed into a plasma jet created by the plasma generator and is gasified by the high temperatures of the plasma jet. The gas produced is then collected, filtered, and utilized, for example, in generating of electricity. Likewise, extra heat produced by the system is also used to generate electricity or other heating purposes.

In another embodiment, a system for gasification of pulverized coal is disclosed including a plasma generator interfaced to a reaction chamber. The coal is pulverized and then fed into a plasma jet created by the plasma generator. The coal is gasified by the high temperatures of the plasma jet and the gas produced is collected, filtered, and utilized, for example, in generating of electricity. Likewise, extra heat produced by the system is also used to generate electricity or other heating purposes.

In another embodiment, a system for gasification of a material is disclosed including a plasma generator interfaced to a reaction chamber. A feedstock such as pulverized coal along with a carrier gas or water is fed into a plasma jet created by the plasma generator and is gasified by the high temperatures of the plasma jet. The gas produced is analyzed and a controller adjusts the feed rates of the feedstock and carrier gas/water and/or the operation of the plasma generator to control the gas generation. The gas is then collected, filtered, and utilized, for example, in generating of electricity. Likewise, extra heat produced by the system is also used to generate electricity or other heating purposes.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
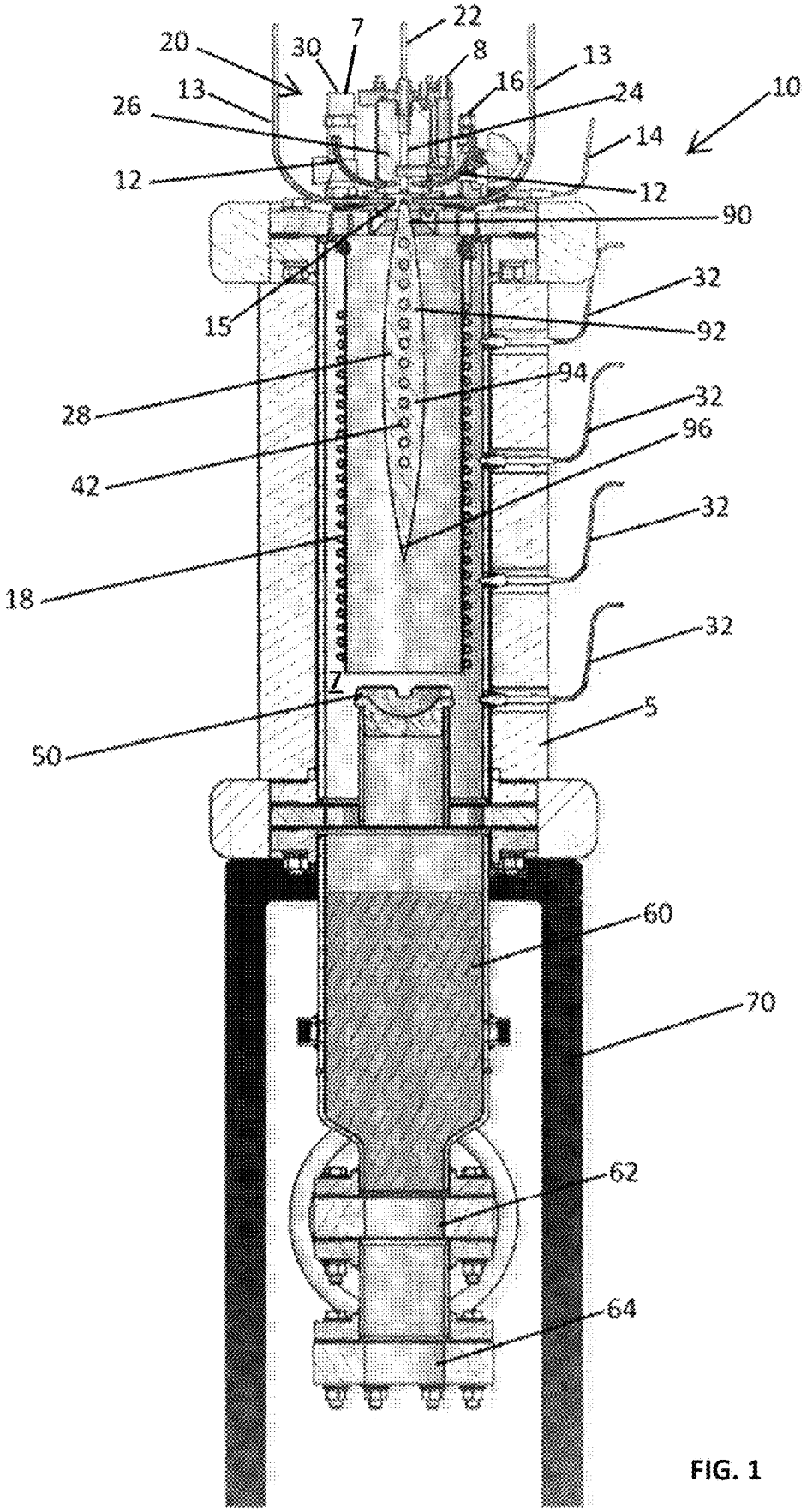
FIG. 1 illustrates a schematic view of a gasification system.

Reference will now be made in detail to the presently preferred embodiments of the invention, examples of which are illustrated in the accompanying drawings. Throughout the following detailed description, the same reference numerals refer to the same elements in all figures.

Throughout this description, an exemplary input material of coal is used for clarity and brevity reasons. The described system is intended to be used with any liquid or solid material, including coal (granular coal), wood (e.g. sawdust), etc.

Figure 2:
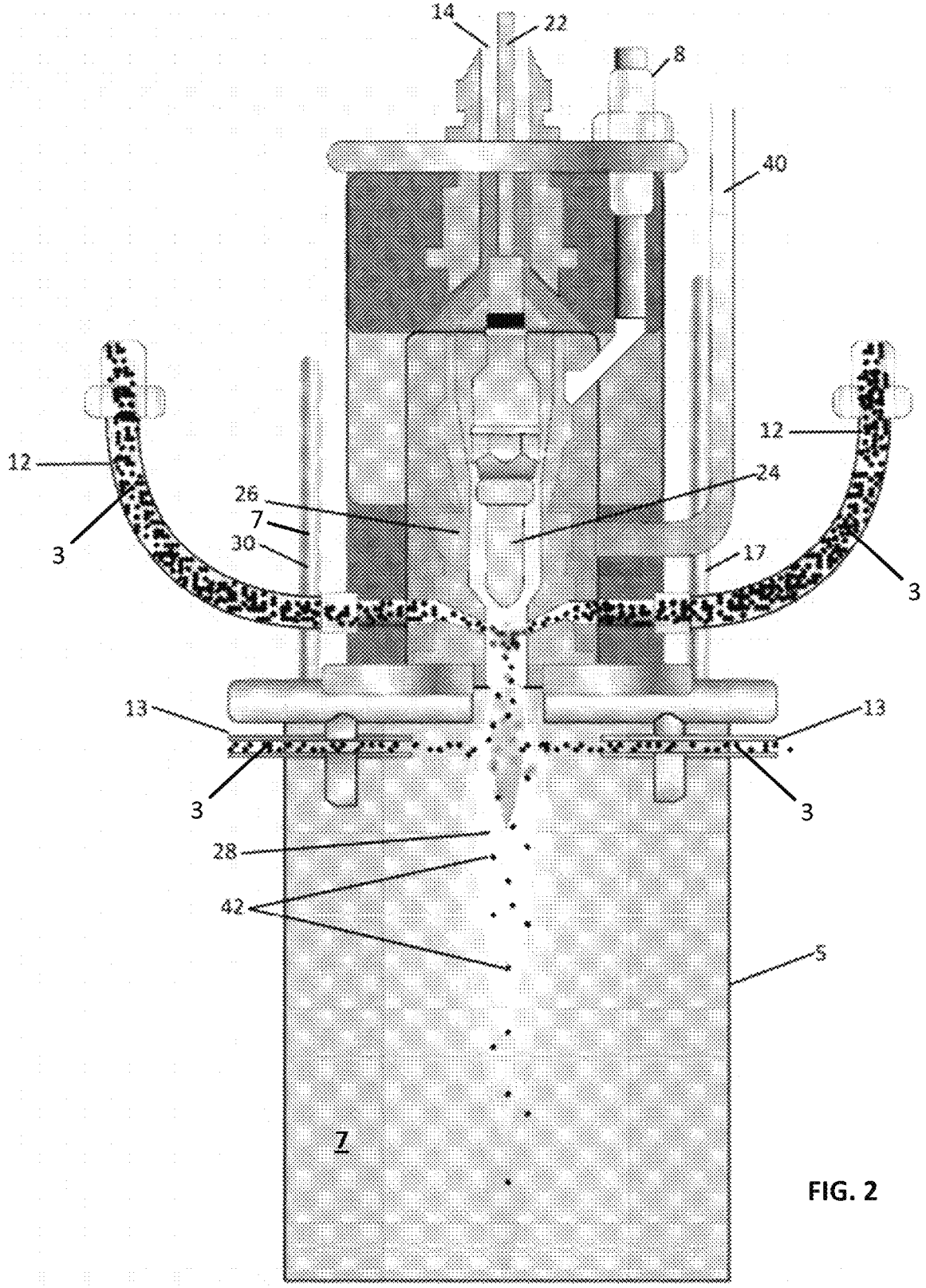
FIG. 2 illustrates a detail view of the plasma gun of the gasification system.
Figure 3:
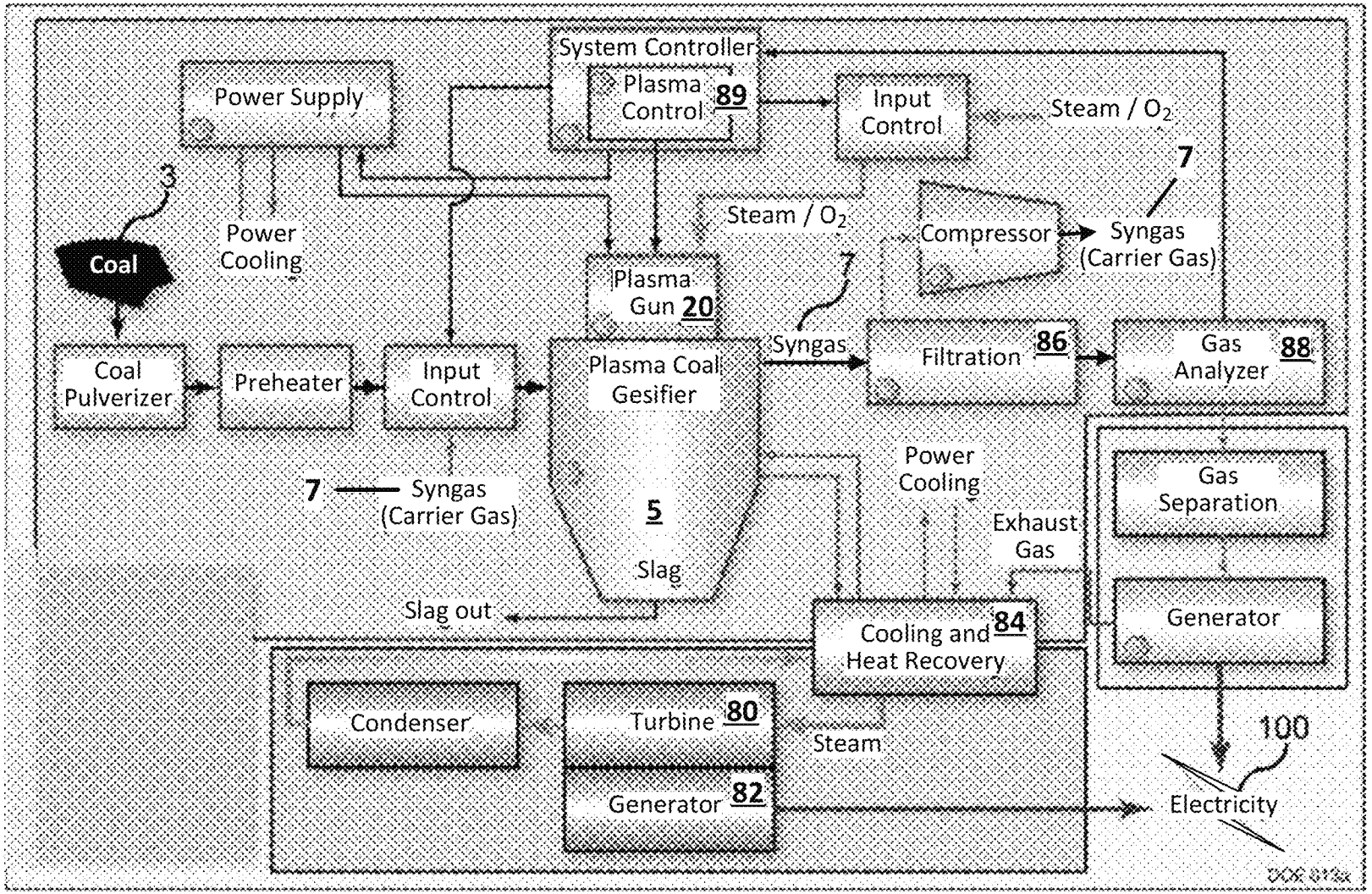
FIG. 3 illustrates a block diagram of the plasma gun of the gasification system.

Referring to FIGS. 1-3, a gasification system 10 is shown. In operation, the gasification system 10 accepts a feedstock of fluid and/or granular/powdered material (e.g., as shown, granular/particulate coal 3) and converts the feedstock into a gas such as syngas 7 and heat. The heat is preferably converted into electricity 100 using, for example, a turbine 80 that runs a generator 82. In some embodiments, the feedstock comprises a liquid, a gas, a liquid mixed with particulate solids, and/or a gas mixed with particulate solids.

Again, granular/particulate coal 3 (e.g. pulverized coal, powdered coal, etc.) is used in the examples as a feedstock. In FIG. 1, the feedstock (e.g. granular or pulverized coal of particulate size of less than 100 μm) enters the gasification system 10 through one or more inputs 12/13 at an anticipated rate of, for example, between one and two pounds per minute. The coal input tubes 12 feed directly into the plasma gun 20. The secondary coal input tubes 13 feed into an insulator 15 between the reaction chamber 5 and the plasma gun 20. Any number of secondary coal input tubes 13 is anticipated, for example, eight coal input tubes 13. The insulator separates the plasma gun 20 from the reaction chamber 5, both electrically and thermally, and is made from a sturdy, insulating material such as phenolic or ceramic. The granular/particulate coal 3 is propelled into the gasification system 10 with the use of a carrier gas selected based upon feed characteristics, resultant syngas, and economics. In some embodiments, oxygen will be injected into the plasma jet 28 at a stoichiometric ratio to the coal composition. The oxygen drives the partial oxidation of the coal. The oxygen injection rate will be modified by analyzing the gas output of the gasification system 10 (gas analyzer 88) as well as temperature readings from one or more temperature sensors 32 interfaced to the reaction chamber 5. The gasification will occur rapidly in the plasma stream due to the high temperature and the small particle size of the granular/particulate coal 3. Several ways are anticipated for adding oxygen for gasification. One is to add oxygen directly into the reaction chamber, and another is to add oxygen via steam. The steam breaks down in the gasification process releasing hydrogen and freeing the oxygen that then couples with the carbon from coal creating CO and reducing the $CO_2$ content of the resultant gas, producing a higher BTU syngas which will create more energy when later combusted to produce to electricity.

In some embodiments, there is a cooling coil 18 that is fed water from a source of water connected to water input 16. It is anticipated that, in some embodiments, a portion of any steam or heated water produced from the cooling coil 18 is also injected into the plasma jet 28, further reducing an amount of energy input, while in some embodiments, a portion of any steam or heated water produced from the cooling coil 18 is used for other energy needs, such as producing electricity, heating buildings, etc.

The syngas 7 that flows from the reaction chamber 5 is routed through a chiller (not shown) for cooling and heat recovery. For example, sulfur is removed by catalytic hydrolysis of COS to $H_2S$ followed by adsorption or the use of an acid gas removal system. The syngas 7 is later compressed, filtered 86, and purified to remove sulfur compounds. The syngas 7 (purified) is, for example, later combusted for the generation of electricity 100.

The syngas 7 that is produced is analyzed by a gas analyzer 88 and the output of the gas analyzer 88 is read by the system controller 89 to control the operation of the plasma gun 20 and the input rates of the feedstock (e.g. granular/particulate coal 3) and the carrier gas.

The plasma gun 20 includes an electric arc struck between the cathode 24 and the anode 26 of the plasma gun in the presence of a processed gas. The arc ionizes the processed gas to form the plasma jet 28 (plasma plume). The plasma jet 28 emanates from the plasma gun 20 at a velocity of, for example, 400 meters per second and at a temperature of from 10,000° K to 20,000° K. Granular/particulate coal 3 and other materials (e.g. carrier gas, oxygen, water) used in the process of gasification enter from the inputs 12/13 into the plasma jet 28. The resulting gas (e.g. syngas 7) exits through a gas output tube 30 for storage and later use. When granular/particulate coal 3 is used in the gasification system 10, the gas emanating from the gas output tube 30 is syngas 7 (synthetic natural gas). A byproduct of the granular/particulate coal 3 that is exposed to the plasma jet 28 is coal slag 42 that falls onto a crucible 50. Coal slag 42 remaining on the crucible remains in contact with the plasma jet 28 and continues to gasify; then as the coal slag 42 accumulates, the coal slag 42 eventually overflows the crucible 50 and falls into a cooling bath 60 (e.g. cooling water). Periodically, accumulated coal slag 42 is emptied from the cooling bath 60 using a pair of valves 62/64, for example, knife valves. In operation, the second valve 64 is closed and the first valve 62 is opened allowing the accumulated coal slag 42 to fall into an area between the first valve 62 and the second valve 64. Then the first valve 62 is closed and the second valve 64 is opened, allowing the accumulated slag 42 to exit from the area between the first valve 62 and the second valve 64.

As it is anticipated that temperatures within the reaction chamber 5 will approach between 10,000° K and 20,000° K, a requirement for cooling is anticipated. For this, the reaction chamber 5 is water-cooled by a cooling coil 18 (or any other circulation system) that surrounds the plasma jet 28 that receives water from a water input pipe 40 and emits steam out of a steam output pipe 17. Although not required, it is fully anticipated that as heat is extracted from the reaction chamber 5 by the cooling coil 18, the steam that is generated is used to generate additional electricity 100 by use of a turbine 80 and generator 82.

For completeness, the gasification system 10 is shown on a stand 70, though any mounting system is anticipated.

The plasma gun 20 is shown in detail in FIG. 2. The cathode 24 is connected to a source of power (e.g. DC power input 22) and the anode 26 is grounded with respect to the cathode 24 through, for example, the steam output pipe 17, which is an electrically conductive pipe made of a material such as copper, steel, or iron. To provide the high temperatures of the plasma jet 28, a gas is fed into the plasma gun 20 through a plasma gas input 8 where it is ionized to create the plasma jet 28.

It is anticipated that temperatures within the reaction chamber 5 will reach, for example, 10,000 degrees Kelvin. For example, in FIG. 1, it is anticipated that the temperature 90 of the plasma jet 28 nearest to the plasma gun 20 will be approximately 10,000° K, with successively lower temperatures 92/94/96 of approximately 8,000° K, 6,000° K, and 4,000° K, respectively. Pulverized coal powder that is directly injected into the 10,000° K plasma jet instantaneously gasifies at, for example, up to 90% efficiency.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A system for gasification of a material, the system comprising:

a reaction chamber;

a plasma generator interfaced to the reaction chamber, the plasma generator positioned to produce a vertically-oriented plasma jet downwardly into the reaction chamber;

a source of material interfaced to the plasma generator, the source of material positioned to feed the material directly into the plasma jet, resulting in gasification of the material into a gas; and means for extracting the gas from the reaction chamber.

2. The system of claim 1, wherein the material comprises coal.

3. The system of claim 1, wherein the material comprises coal combined with a carrier gas.

4. The system of claim 1, wherein the material comprises coal combined with water.

5. The system of claim 1, wherein the reaction chamber further comprises a cooling coil configured to circulate a liquid.

6. The system of claim 5, further comprising an electric generator connected to the cooling coil and positioned to receive the liquid after the liquid has circulated through the cooling coil, the electric generator configured to use heat energy from the liquid to generate electricity.

7. The system of claim 5, further comprising an input to the plasma jet, the input being connected to the cooling coil and positioned to receive the liquid that has circulated through the cooling coil, and to insert the liquid into the plasma jet.

8. The system of claim 1, further comprising a crucible positioned beneath the plasma generator, the crucible being positioned to receive slag and to hold the slag in contact with the plasma jet.

9. A system for gasification of a material, the system comprising:

a reaction chamber;

a plasma generator interfaced to the reaction chamber;

a source of material interfaced to an input port of the plasma generator such that the material enters a plasma emitted from the plasma generator resulting in gasification of the material into a gas;

a cooling coil interfaced to the reaction chamber, the cooling coil positioned to surround the plasma and circulate a liquid around the reaction chamber; and means for extracting the gas from the reaction chamber.

10. The system of claim 9 wherein the material comprises coal.

11. The system of claim 9, wherein the material comprises coal combined with a carrier gas.

12. The system of claim 9, wherein the material comprises coal combined with water.

13. The system of claim 9, further comprising an electric generator connected to the cooling coil and positioned to receive the liquid after the liquid has circulated through the cooling coil, the electric generator configured to use heat energy from the liquid to generate electricity.

14. The system of claim 9, further comprising a second input port to the plasma, the second input port positioned to receive the liquid that has circulated through the cooling coil, and to insert the liquid into the plasma.

* * * * *